US006510766B1

(12) United States Patent
Lin

(10) Patent No.: US 6,510,766 B1
(45) Date of Patent: Jan. 28, 2003

(54) HEX WRENCH STORAGE MEMBER

(76) Inventor: Chiang-Her Lin, No. 22-8, Jiann Dong Road, Dah Li City, Taichung Hsien (TW)

( * ) Notice: Subject to any disclaimer, the term of this patent is extended or adjusted under 35 U.S.C. 154(b) by 0 days.

(21) Appl. No.: 10/041,879

(22) Filed: Jan. 10, 2002

(51) Int. Cl.[7] ..... B25B 23/16
(52) U.S. Cl. ..... 81/177.4; 81/177.5; 81/439
(58) Field of Search ..... 81/436, 438, 439, 81/177.1, 177.2, 177.4, 177.5, 489, 490

(56) References Cited

U.S. PATENT DOCUMENTS 4,043,230 A * 8/1977 Scrivens ..... 81/177.2
D373,943 S * 9/1996 Fuhrmann ..... D6/468
5,911,799 A * 6/1999 Johnson et al. ..... 81/177.4
6,332,381 B1 * 12/2001 Vasudeva ..... 81/177.2

* cited by examiner

*Primary Examiner*—Eileen P. Morgan
*Assistant Examiner*—Joni B. Danganan
(74) *Attorney, Agent, or Firm*—Charles E. Baxley

(57) ABSTRACT

A hex wrench storage member includes a tubular body that has a recess defined in the body and communicating with an outer periphery of the body at a first opening and communicating with an end of the body at a second opening. The recess is defined by several stepped surfaces each of which receives respective one of two ends of the hex wrenches and the other end of the hex wrench protrudes from the recess so that the tubular body can be used as a T-bar handle. A plurality of holes are defined in an end of the body so as to respective receive the hex wrenches.

2 Claims, 6 Drawing Sheets

HEX WRENCH STORAGE MEMBER

FIELD OF THE INVENTION

The present invention relates to a storage member for receiving hex wrenches and the storage member can be used as a T-bar handle when connecting with the hex wrenches.

BACKGROUND OF THE INVENTION

A conventional hex wrench storage box 20 is shown in FIG. 6 so as to receive hex wrenches 22 therein. Each of the hex wrenches 22 is cooperated with a T-bar handle 21 which is usually fixed to the hex wrench. The T-bar handles 21 occupy a lot of space in the storage box 20 so that a limited number of hex wrenches 22 can be stored in the box 20. A large storage box 20 is required to store different sizes of the hex wrenches.

SUMMARY OF THE INVENTION

In accordance with one aspect of the present invention, there is provided a hex wrench storage member which comprises a tubular body with a recess which communicates with an outer periphery of the body at a first opening, and communicates with an of the body at a second opening. The first opening is defined by two opposite surfaces and a U-shaped inside connected between the two opposite surfaces. Each of the two opposite surfaces includes a plurality of stepped surfaces and the U-shaped inside includes a plurality of stepped areas which are connected between the stepped surfaces. A plurality of holes are defined in the end of the body.

The primary object of the present invention is to provide a hex wrench storage member which can be used as a T-bar handle and receives all the hex wrenches with different sizes.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
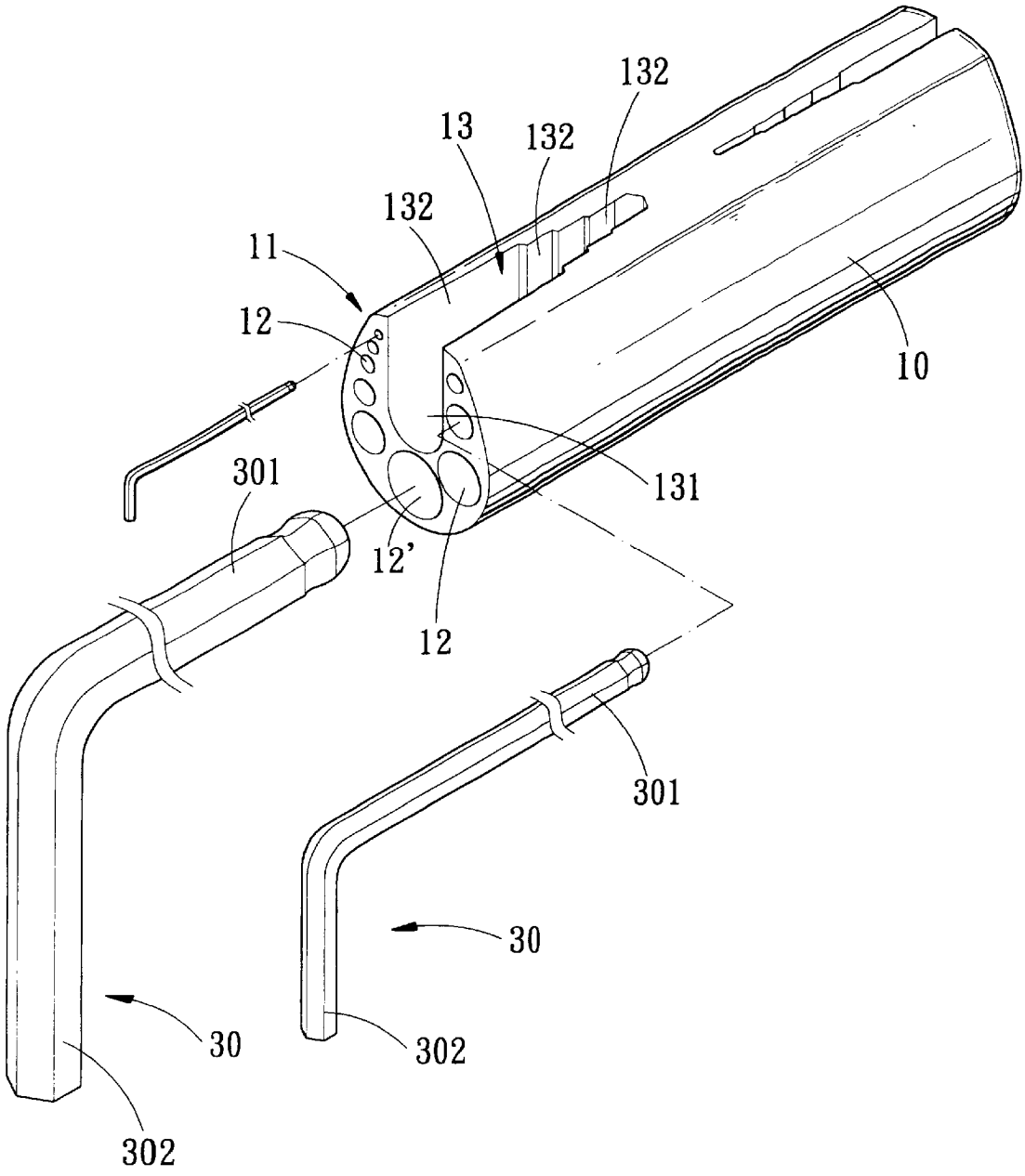
FIG. 1 is an exploded view to show the tubular body of the storage member of the present invention and hex wrenches.
Figure 2:
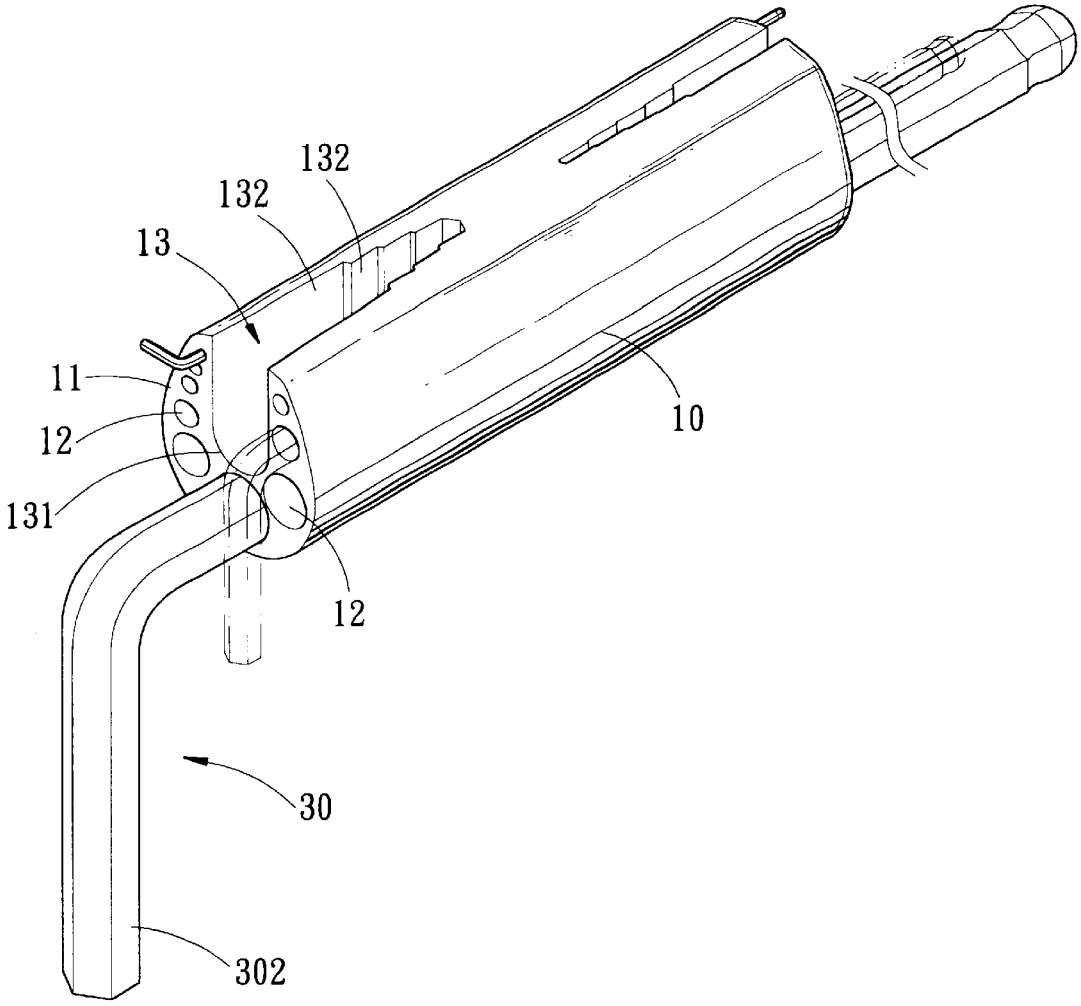
FIG. 2 is a perspective view to show the hex wrenches are received in the tubular body of the storage member of the present invention.

Referring to FIGS. 1 and 2, the hex wrench storage member of the present invention comprises a tubular body 10 which has a recess defined therein. The recess communicates with an outer periphery of the body 10 at a first opening 13, and communicates with an end 11 of the body 10 at a second opening 131.

The first opening 13 is defined by two opposite surfaces and a U-shaped inside connected between the two opposite surfaces. Each of the two opposite surfaces includes a plurality of stepped surfaces 132 and the U-shaped inside includes a plurality of stepped areas 133 which are connected between the stepped surfaces 132. The stepped surfaces 132 and the stepped areas 133 are complied with the sizes of the hex wrenches 30 to be engaged therewith. The sizes of the stepped surfaces 132 and the stepped areas 133 are located in sequences so that the larger stepped surfaces 132 and stepped areas 133 are located close to the end of the body 10. A plurality of holes 12 are defined in the end 11 of the body 10. A passage 12' is defined longitudinally through the body 10.

Figure 3:
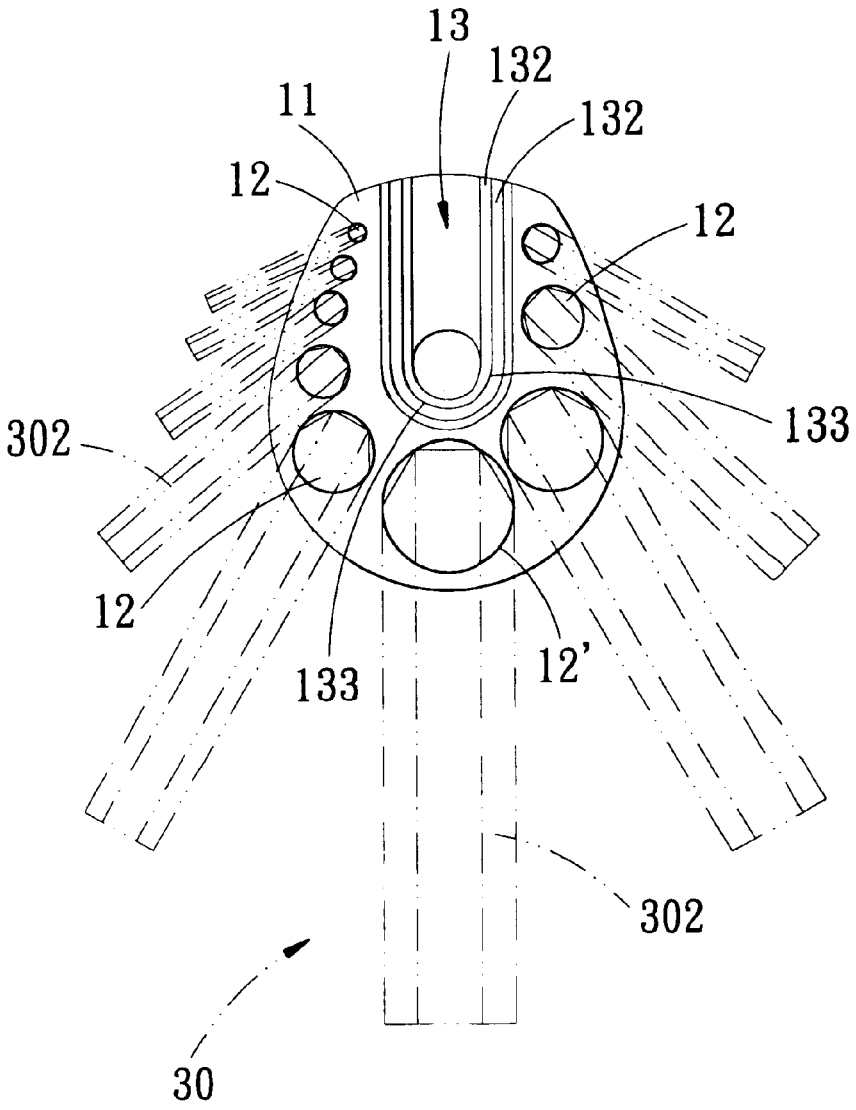
FIG. 3 is an end view to show all the hex wrenches are received in holes in one end of the tubular body of the storage member of the present invention.

Each of the hex wrenches 30 to be received in the body 10 includes a head 302 and a handle 301. All the hex wrenches 30 are inserted in the holes 12 as shown in FIG. 3 so that the combination of the body 10 and the hex wrenches 30 occupy a limited space.

Figure 4:
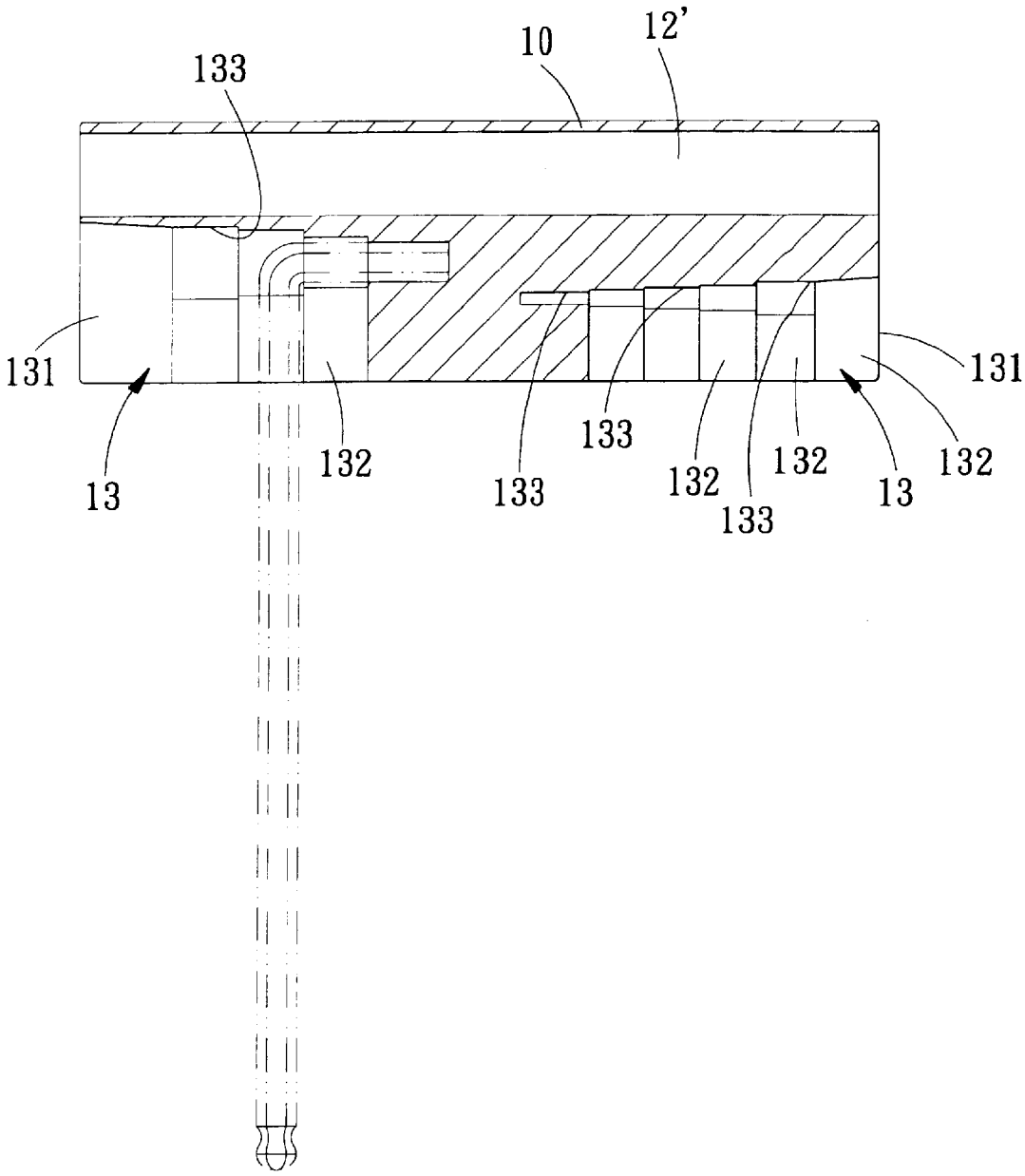
FIG. 4 is a cross sectional view to show one hex wrench is engaged with the recess in the tubular body which is used as a T-bar handle.
Figure 5:
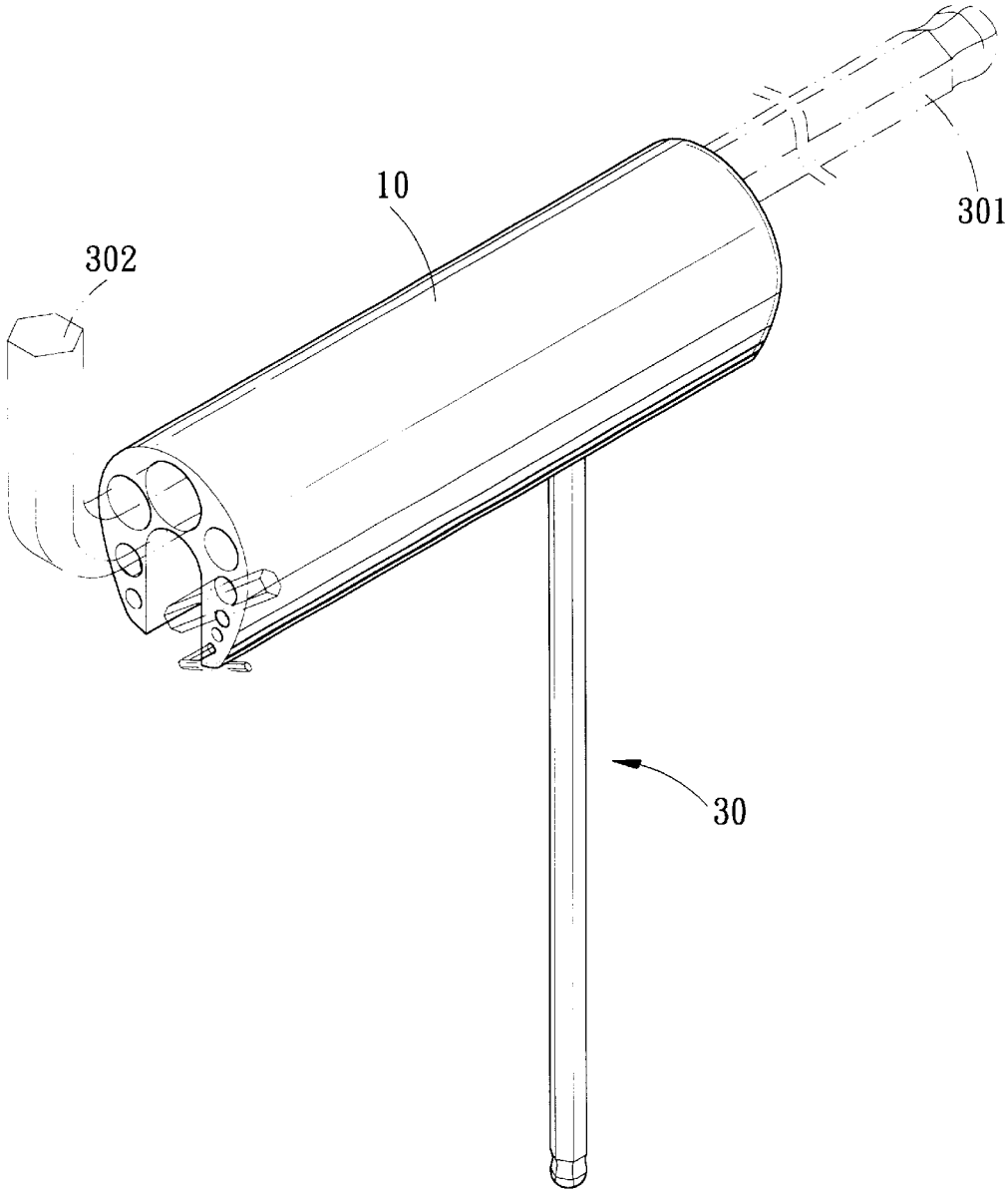
FIG. 5 is a perspective view to show the longest hex wrench can be used as an extension of the T-bar handle.
Figure 6:
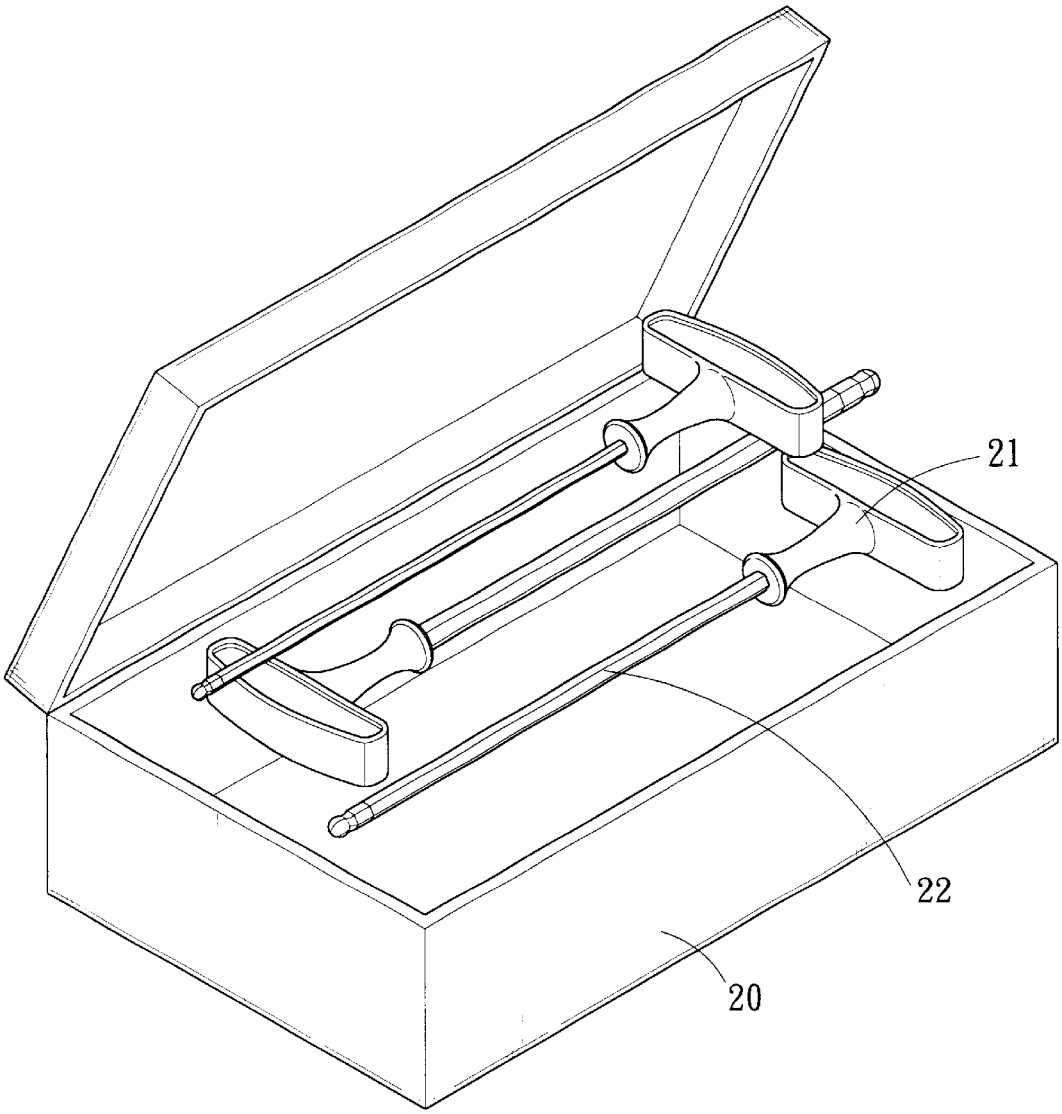
F I G. 6 PRIOR ART
FIG. 6 is a perspective view to show a conventional hex wrench storage box.

As shown in FIG. 4, the head 302(the handle 301) can be engaged with the proper size of the stepped surfaces 132 and the stepped area 133, and the handle 301(the head 302) protrudes from the first opening 13. The body 10 can be used as a T-bar handle. The longest hex wrench extends through the passage 121 as shown in FIG. 5 and used as an extension of the T-bar handle as shown in FIG. 5.

While we have shown and described the embodiment in accordance with the present invention, it should be clear to those skilled in the art that further embodiments may be made without departing from the scope of the present invention.

What is claimed is:

1. A hex wrench storage member comprising:

a generally cylindrical body;

a recess defined in said body and communicating with an outer periphery of said body at a fist opening, said first opening defined by two opposite surfaces and a U-shaped inside connected between said two opposite surfaces, each of said two opposite surfaces including a plurality of stepped surfaces and said U-shaped inside including a plurality of stepped areas which are connected between said stepped surfaces, said recess communicating with an end of said body at a second opening, a plurality of holes defined in said end of said body.

2. The storage member as claimed in claim 1 further comprising a passage defined longitudinally through said body.

* * * * *